US009074452B2

(12) United States Patent
Andrea et al.

(10) Patent No.: US 9,074,452 B2
(45) Date of Patent: Jul. 7, 2015

(54) ACTIVELY ENERGIZED DYNAMIC SEAL SYSTEM

(75) Inventors: Sbordone Andrea, Singapore (SG); Le Moign Yves, Singapore (SG)

(73) Assignee: OneSubsea, LLC, Houston, TX (US)

( * ) Notice: Subject to any disclaimer, the term of this patent is extended or adjusted under 35 U.S.C. 154(b) by 1104 days.

(21) Appl. No.: 12/127,837

(22) Filed: May 28, 2008

(65) Prior Publication Data

US 2009/0294120 A1 Dec. 3, 2009

(51) Int. Cl.
*E21B 23/00* (2006.01)
*E21B 33/12* (2006.01)
*E21B 33/076* (2006.01)

(52) U.S. Cl.
CPC ..... *E21B 33/076* (2013.01)

(58) Field of Classification Search
CPC ..... E21B 33/076; E21B 33/06
USPC ..... 166/368, 338, 339, 341, 342, 349, 352, 166/367, 77.1
See application file for complete search history.

(56) References Cited

U.S. PATENT DOCUMENTS

| | | | | |
|---|---|---|---|---|
| 4,483,569 | A | 11/1984 | Smith | |
| 4,951,745 | A | 8/1990 | Gentry et al. | |
| 6,321,846 | B1 * | 11/2001 | Rytlewski | 166/363 |
| 6,953,085 | B2 | 10/2005 | Nice | |
| 7,137,610 | B2 * | 11/2006 | Lam | 251/1.3 |
| 7,757,771 | B2 * | 7/2010 | Howlett | 166/336 |
| 7,828,064 | B2 * | 11/2010 | Robichaux et al. | 166/358 |
| 7,845,412 | B2 | 12/2010 | Sbordone et al. | |
| 2005/0061499 | A1 * | 3/2005 | Hopper | 166/84.3 |
| 2005/0115715 | A1 | 6/2005 | Howlett | |
| 2010/0139926 | A1 | 6/2010 | Sbordone et al. | |

FOREIGN PATENT DOCUMENTS

| | | |
|---|---|---|
| GB | 2359106 | 8/2001 |
| WO | 2007/008085 | 1/2007 |

* cited by examiner

*Primary Examiner* — James G Sayre
(74) *Attorney, Agent, or Firm* — Chamberlain Hrdlicka

(57) ABSTRACT

A technique for subsea intervention operations utilizes a retrievable dynamic seal system. The technique provides an improved dynamic seal system that is retrievable from a subsea installation. A retrievable dynamic seal is deployed with a tool string on a conveyance and positioned in or at the subsea installation. The retrievable dynamic seal is then actuated to form a seal with the conveyance by mechanically manipulating a seal element to force the seal element into sealing engagement with the conveyance.

25 Claims, 11 Drawing Sheets

ACTIVELY ENERGIZED DYNAMIC SEAL SYSTEM

BACKGROUND

The retrieval of hydrocarbon based fluids is pursued in subsea environments. Production and transfer of fluids from subsea wells relies on subsea installations, subsea flow lines and other equipment. Additionally, preparation and servicing of the subsea well relies on the ability to conduct subsea intervention work. A big challenge in subsea intervention work is controlling pressure so that pressurized borehole fluids in the subsea well are contained within the borehole during intervention operations.

In many applications, a pressure tight, dynamic seal is provided in the vicinity of the seabed. This type of seal allows a conveyance member, such as a wireline, slickline, coiled tubing, or other suitable conveyance, to be moved up and down inside a subsea installation, e.g. a well or flow line. The conveyance moves a tool string used in performing intervention operations. During conveyance movement, the dynamic seal contains pressurized fluids within the subsea installation to prevent escape of pressurized fluids into the environment or into a tubular, e.g. rigid riser, flexible riser, or spoolable compliant guide, connected to the subsea installation.

Some of these applications use a retrievable dynamic seal to facilitate maintenance of the dynamic seal and replacement of its sealing element. The dynamic seal can be deployed from a surface vessel to the subsea installation together with an intervention tool string and conveyance member. Similarly, the dynamic seal can be retrieved with the conveyance member for maintenance and servicing. However, difficulties can arise in positioning the dynamic seal in the subsea installation, locking the dynamic seal in place, and activating the dynamic seal.

SUMMARY

In general, the present invention provides an improved dynamic seal system that is retrievable from a subsea installation. A retrievable dynamic seal is deployed on a conveyance with a tool string to the subsea installation. The retrievable dynamic seal is then positioned in or at the subsea installation and actuated to form a seal with the conveyance. The actuation involves mechanically manipulating a seal element to force the seal element into sealing engagement with the conveyance.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

Figure 1:
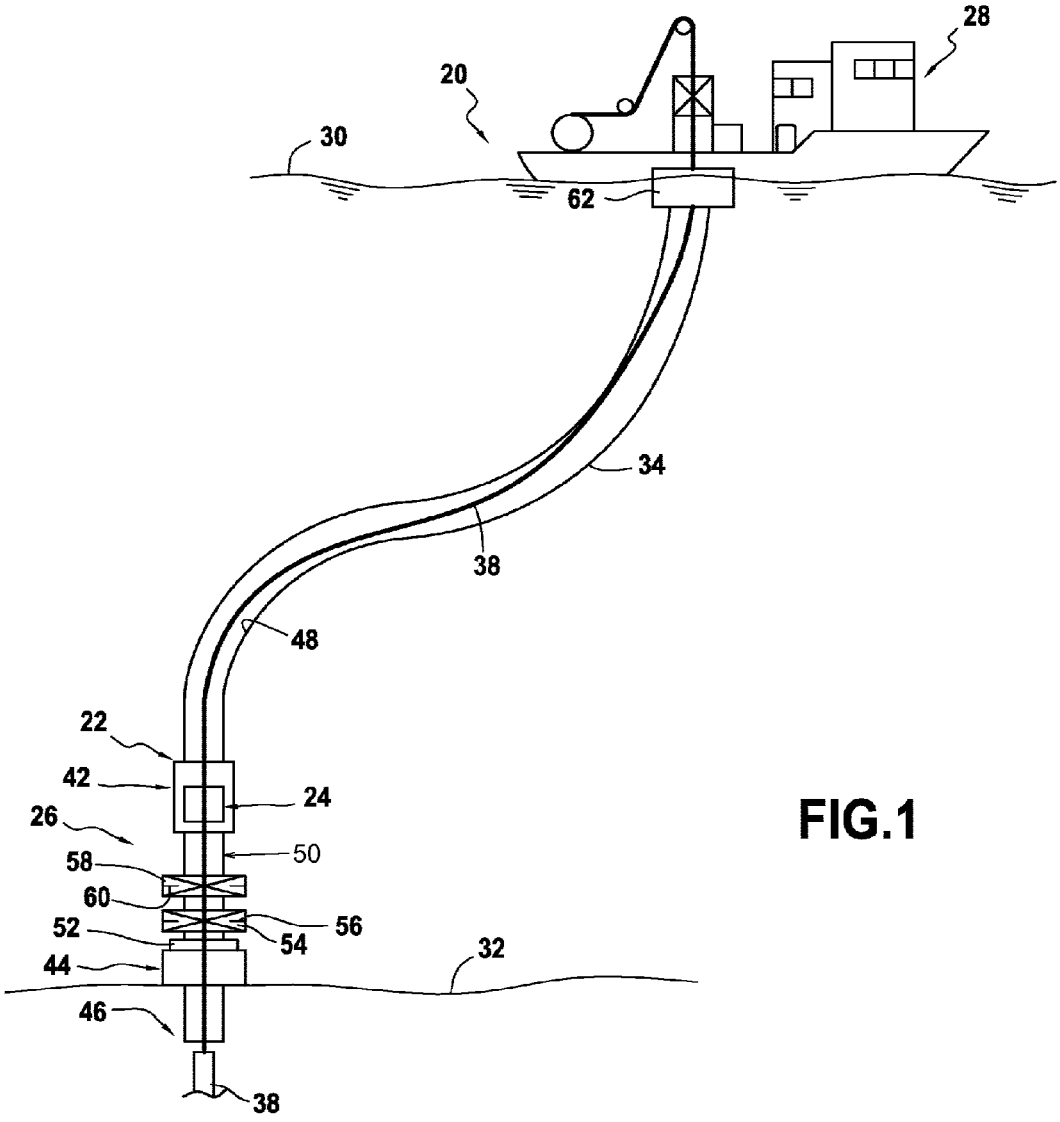
FIG. 1 is a schematic front elevation view of a subsea intervention system, according to an embodiment of the present invention.

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a technique for intervening in subsea installations, such as subsea wells or flow lines. The technique involves an innovative way of constructing and using a retrievable dynamic seal in the oil and gas industry, for example. The overall system uses mechanical features, such as rams, to temporarily lock the retrievable dynamic seal at a desired position within the subsea installation and to compress a seal element to establish a dependable seal against a conveyance.

Although the overall system may comprise a variety of components and configurations, one embodiment provides a retrievable dynamic seal installed around a conveyance while at a surface location. The retrievable dynamic seal may be installed above and proximate an intervention tool string. In some applications, the retrievable dynamic seal is temporarily locked in place on the tool string and/or the conveyance with a releasable locking device while the retrievable dynamic seal is conveyed from a surface location to a subsea installation. The tool string can be moved into and through the subsea installation, and the retrievable dynamic seal is moved to its intended position with respect to the subsea installation. For example, the retrievable dynamic seal may be installed in the subsea installation towards an upper portion of the installation.

Once the retrievable dynamic seal is accurately positioned within the subsea installation, the retrievable dynamic seal is temporarily locked in place by a suitable mechanical mechanism, such as a ram. The dynamic seal is then released from the conveyance/tool string by, for example, releasing the locking device. Subsequently, retrievable dynamic seal is actuated by a mechanical actuation system that acts against a sealing element. For example, the sealing element can be compressed by a set of rams to seal against the conveyance and thereby provide a pressure barrier able to withstand differential pressure from above or below. The seal is maintained during movement of the conveyance which enables the intervention operation to be performed while maintaining a dynamic seal active against the conveyance.

After completing the desired intervention operation, the well pressure is bled off and the retrievable dynamic seal can be deactivated by, for example, opening the appropriate rams. If necessary, the dynamic seal can again be locked onto the conveyance and/or tool string. The dynamic seal also is released from the subsea installation by, for example, opening another set of rams. Once released, the retrievable dynamic seal, conveyance and tool string can be retrieved to the surface.

Referring generally to FIG. 1, an intervention system 20 is illustrated according to an embodiment of the present invention. In this embodiment, system 20 comprises a dynamic seal system 22 having a retrievable dynamic seal 24. Intervention system 20 further comprises a subsea installation 26 and a surface vessel 28, such as an intervention vessel located at a surface 30 of the sea. Subsea installation 26 may be located on or at a seabed floor 32. The retrievable dynamic seal 24 can readily be deployed from the surface vessel 28 to the subsea installation 26 and then retrieved when desired. During deployment and retrieval, the retrievable dynamic seal 24 can be moved through open water in, for example, a riserless system, or through a tubular 34, such as a rigid riser, a flexible riser, or a spoolable compliant guide. In some embodiments, tubular 34 is a flexible, compliant guide and retrievable dynamic seal 24 is sized for deployment and retrieval along the interior of the compliant guide.

Regardless as to whether tubular 34 is used in a specific intervention operation, retrievable dynamic seal 24 can be mounted around a conveyance 38 and deployed to subsea installation 26 with a tool string 40. The retrievable dynamic seal 24 can be temporarily secured to conveyance 38 and/or tool string 40 during deployment to subsea installation 26. As described in greater detail below, the retrievable dynamic seal may be coupled to conveyance 38 until locked into position at a desired subsea location 42 at subsea installation 26. Subsequently, the retrievable dynamic seal 24 is released from conveyance 38 and is activated to maintain a seal against conveyance 38 as the conveyance is moved to deploy and/or retrieve intervention tool string 40 for the desired intervention operation.

It should be noted retrievable dynamic seal 24 can be deployed via many different types of conveyances 38. For example, conveyance 38 may be a flexible, cable-type conveyance, such as a wireline, slickline or a line having fiber optics. However, conveyance 38 also may comprise stiffer mechanisms including coiled tubing, coiled rod and other conveyances suitable for performance of a given intervention operation.

Although a variety of subsea installations 26 can be utilized depending on the particular environment and type of intervention operation, one example is illustrated in FIG. 1. In this example, the subsea installation 26 comprises a subsea wellhead 44, which may include a Christmas tree, coupled to a subsea well 46. The retrievable dynamic seal 24 is positioned generally at the top of the subsea installation 26, however other locations may be suitable for a variety of intervention operations.

In the embodiment illustrated, retrievable dynamic seal 24 is generally positioned above or within a subsea lubricator 50 of subsea installation 26. As illustrated, subsea installation 26 also may comprise a variety of other components. For example, subsea installation 26 comprises a lubricating valve 52 that may be deployed directly above subsea wellhead 44. Lubricating valve 52 can be used to close the borehole of subsea well 46 during certain intervention operations, such as tool change outs. A blowout preventer 54 may be positioned above lubricating valve 52 and may comprise one or more cut-and-seal rams 56 able to cut through the interior of the subsea installation and seal off the subsea installation during an emergency disconnect. The subsea installation 26 also may comprise a second blowout preventer 58 positioned above blowout preventer 54 and comprising one or more sealing rams 60 able to seal against the conveyance 38. Many other components, e.g. an emergency disconnect device 62, also can be incorporated into intervention system 20 depending on the specific intervention application.

In operation, the retrievable dynamic seal 24 is designed to prevent the escape of borehole fluids from subsea well 46 or from other regions of a subsea flow line system. The dynamic seal 24 seals against conveyance 38, and may be designed to seal against a variety of conveyances, such as those listed above. The retrievable dynamic seal 24 can be designed with a variety of controllable seal elements to form seals against many types of conveyances.

Figure 2:
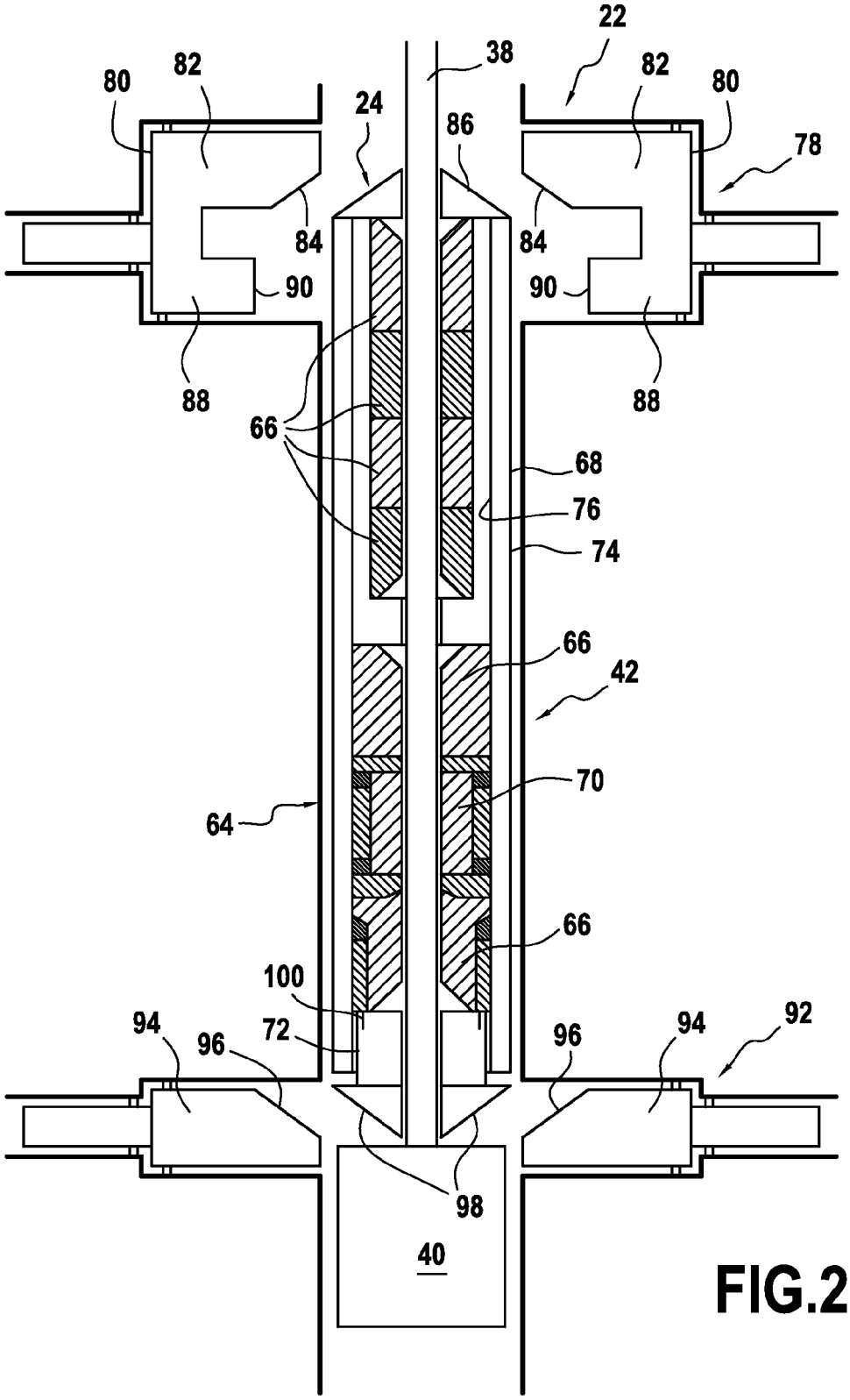
FIG. 2 is a schematic illustration of a retrievable dynamic seal positioned in a subsea installation, according to an embodiment of the present invention.

Referring generally to FIG. 2, one embodiment of dynamic seal system 22 is illustrated. In this embodiment, dynamic seal system 22 comprises retrievable dynamic seal 24 which is mounted around conveyance 38 proximate tool string 40 for deployment into subsea installation 26. For example, the retrievable dynamic seal 24 is deployed to a desired subsea location 42 within a tubular member 64 of subsea installation 26. Tubular 64 is generally a housing in which the retrievable dynamic seal 24 can be locked in place during performance of a desired intervention operation. Depending on the specific intervention operation, tool string 40 may comprise a variety of tools, equipment and devices.

The retrievable dynamic seal 24 may have a variety of configurations and comprise many types of components. By way of example, retrievable dynamic seal 24 comprises a plurality of bushings 66 mounted around conveyance 38 in a manner that allows movement of conveyance 38 therethrough. The bushings 66 are mounted within a dynamic seal housing or body 68 that may be generally tubular in shape. The dynamic seal 24 further comprises one or more sealing elements 70 that may be selectively manipulated to form a dynamic sealing engagement against conveyance 38. An activating cursor 72 can be used to manipulate sealing element 70 into sealing engagement with conveyance 38. For example, activating cursor 72 can be moved linearly along conveyance 38 to linearly compress sealing element 70 between conveyance 38 and body 68 until the sealing element 70 is expanded into sealing engagement with conveyance 38. In this embodiment, controlling the vertical compression of the one or more sealing elements 70 enables an operator to control the sealing effect applied with respect to conveyance 38.

In the example illustrated, retrievable dynamic seal body 68 also is used to contain the one or more sealing elements 70 and the activating cursor 72. In many applications, body 68 may be cylindrical and formed out of metallic materials or other materials having suitable mechanical and chemical properties for a given intervention application. An outer surface 74 of body 68 is designed to have regions that enable formation of a pressure tight seal along the exterior of body 68, as described in greater detail below. The body 68 also comprises an inner surface 76 having regions designed to provide a suitable surface for establishing a pressure tight seal when the sealing element 70 is compressed against inner surface 76 and conveyance 38.

Dynamic seal system 22 further comprises a positioning mechanism 78 designed to position and hold retrievable dynamic seal 24 at desired location 42 during the intervention operation. By way of example, positioning mechanism 78 may comprise one or more rams 80 that are positioned and designed to selectively engage retrievable dynamic seal 24. In the embodiment illustrated, for example, rams 80 are positioned at an upper end of retrievable dynamic seal 24 when the dynamic seal is located within tubular 64.

Although positioning mechanism 78 may have a variety of configurations, one example utilizes a plurality of rams 80 in which each ram 80 has a ram portion 82 with an engagement surface 84, e.g. an inclined surface, oriented to engage a corresponding feature 86 of retrievable dynamic seal 24. As illustrated, corresponding feature 86 may be positioned at an upper end of the retrievable dynamic seal. Each ram 80 further comprises a gripping portion 88 having a gripping surface 90 oriented for movement against the outer surface 74 of retrievable dynamic seal body 68. The gripping surfaces 90 are designed to enable formation of a seal against outer surface 74 when gripping portions 88 are moved into gripping engagement with body 68. In some applications, body 68 may comprise a lower profile or shouldered area designed to further facilitate a solid grip between gripping portions 88 and retrievable dynamic seal body 68.

The upper set of rams 80 is used to provide a first positioning point for the retrievable dynamic seal 24. The rams 80 can then be closed to further grab the retrievable dynamic seal body 68 and to establish a pressure tight seal against body 68. Once gripping portions 88 are engaged with body 68, the retrievable dynamic seal 24 is locked in place and no movement of the dynamic seal occurs when it is subjected to the forces incurred during movement of conveyance 38 upwardly and downwardly during an intervention operation. The seal also is sufficient to withstand the differential pressures that can occur above and below the retrievable dynamic seal. When not in use, the rams 80 can be opened to the full size of tubular 64 to allow passage of intervention tool string 40. The rams 80 also can be designed to have a partially closed position that is used to facilitate positioning of the retrievable dynamic seal 24.

Dynamic seal system 22 further comprises an activating mechanism 92 used to actuate retrievable dynamic seal 24 so as to sealingly engage conveyance 38. Activating mechanism 92 may be constructed in a variety of configurations. However, one embodiment is illustrated in FIG. 2 as having one or more activating rams 94, e.g. a plurality of activating rams, positioned for radial movement. In the embodiment illustrated, activating rams 94 are positioned generally at a lower and of retrievable dynamic seal 24 when the dynamic seal is located in tubular 64. Each activating ram 94 may comprise an engagement surface 96, such as an inclined surface, oriented to engage a corresponding feature 98 operatively coupled with activating cursor 72. When the activating rams 94 are moved radially inward, engagement surfaces 96 move against corresponding features 98 and force activating cursor 72 in an upward direction. The movement of activating cursor 72 compresses sealing element 70 until a sufficient seal is formed against conveyance 38. When the activating rams 94 are not in use, the rams can be opened to the full size of tubular 64 to enable passage of tool string 40.

The rams 80 and the activating rams 94 can be actuated by a variety of actuation techniques. For example, the rams 80 and/or activating rams 94 can be hydraulically actuated, mechanically actuated, electrically actuated, or actuated by a mixture of techniques. Depending on the actuation technique, the rams/activating rams may have a variety of sizes and configurations.

The activating cursor 72 also can be constructed in a variety of forms for cooperation with activating rams 94. For example, the activating cursor 72 may be constructed with a spring device 100 positioned to facilitate the deactivation of retrievable dynamic seal 24 when the activating rams 94 are moved to an open position. The cursor 74 also can be designed as a pressure balanced cursor such that well pressure has no effect on its movement. Furthermore, interaction between activating cursor 72 and activating rams 94 can occur in different ways. For example, the activating cursor 72 may have conically shaped corresponding feature surfaces to facilitate interaction with activating rams 94 regardless of the orientation of the activating rams. In this example, the engagement surface of each activating ram 94 can have either a matching conical surface or a flat inclined surface designed to grab the corresponding conical shape of the activating cursor. Alternatively, activating cursor 72 can utilize corresponding features 98 that have flat surfaces, with a triangular or trapezoidal cross-section. Some surface configurations may benefit from orientation mechanisms to align corresponding surfaces of the activating cursor 72 and the activating rams 94. Furthermore, the activating cursor 72 and/or the activating rams 94 can incorporate force transmission elements, such as rollers, low friction sliding surfaces, and other types of elements.

Figure 3:
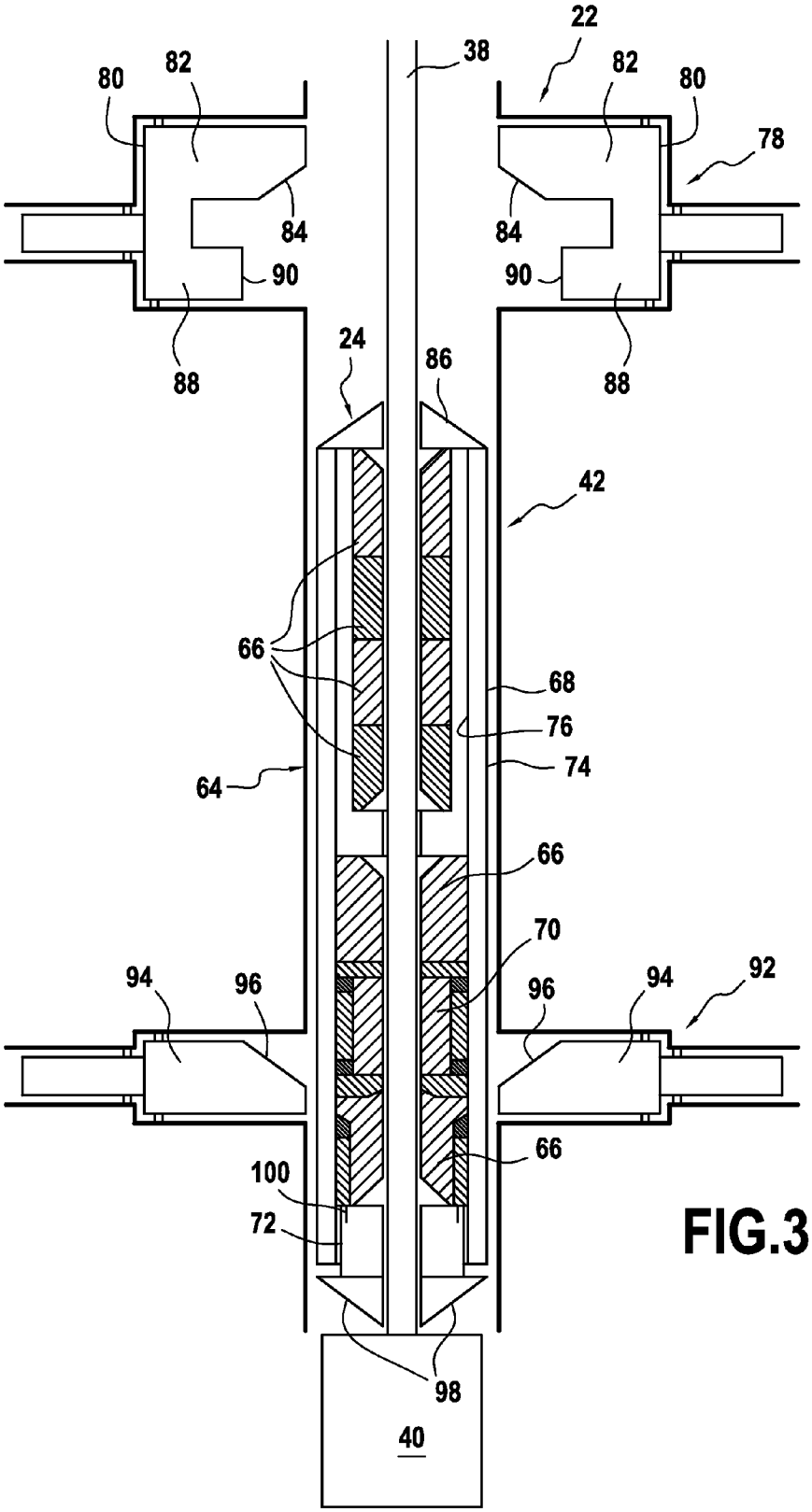
FIG. 3 is a schematic illustration of the retrievable dynamic seal positioned in a subsea installation during an initial stage of deployment, according to an embodiment of the present invention.
Figure 4:
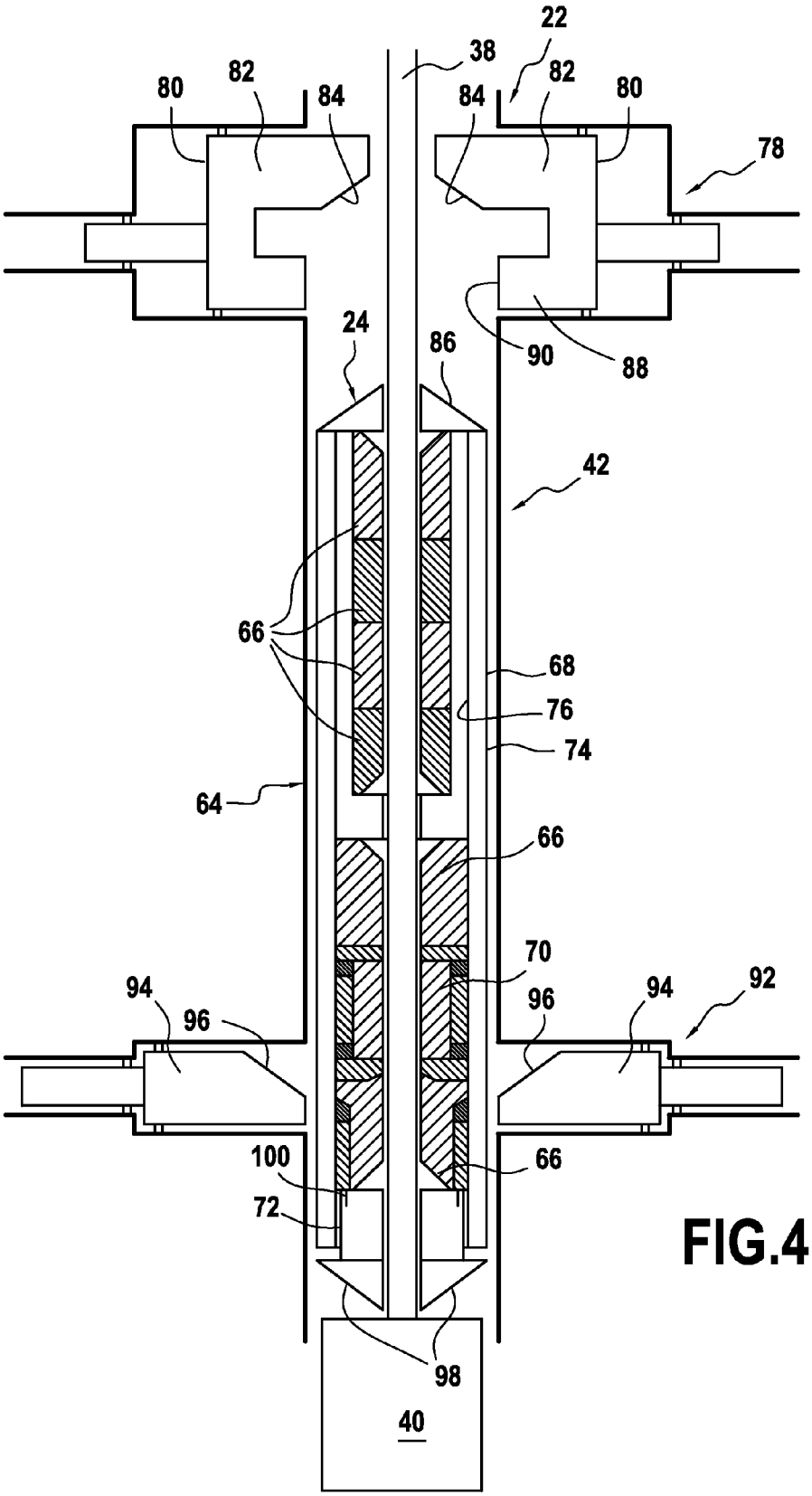
FIG. 4 is a schematic illustration of the retrievable dynamic seal positioned in a subsea installation during a subsequent stage of deployment, according to an embodiment of the present invention.
Figure 5:
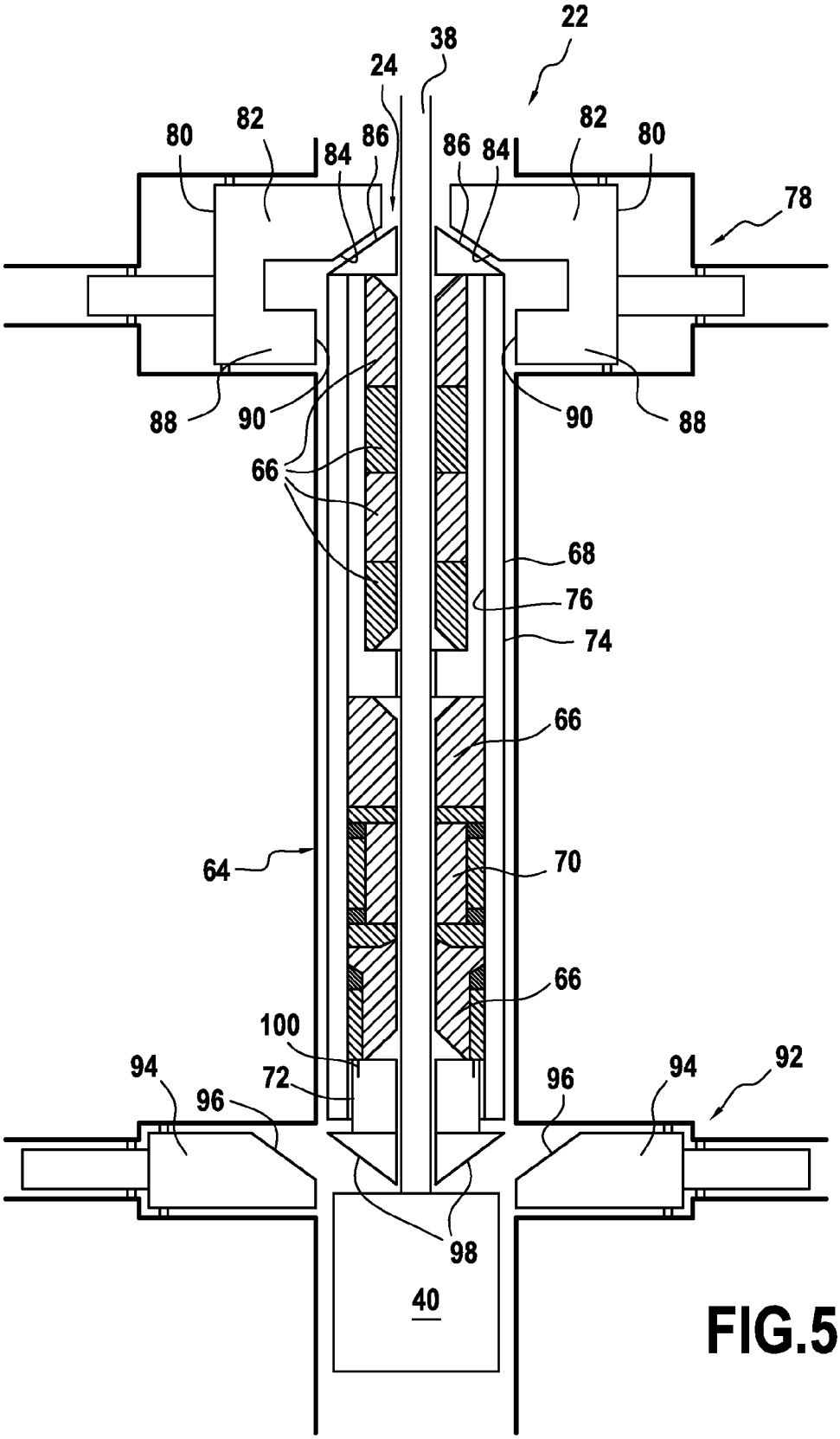
FIG. 5 is a schematic illustration of the retrievable dynamic seal positioned in a subsea installation during a subsequent stage of deployment, according to an embodiment of the present invention.

In operation, the tool string 40 and retrievable dynamic seal 24 are lowered to a positioned below the desired location 42, as illustrated in FIG. 3. In this position, rams 80 and activating rams 94 are in the fully open position to allow the downward passage of tool string 40 and retrievable seal device 24. Subsequently, the upper rams 80 are actuated and moved radially inward to a partially closed position, as illustrated in FIG. 4. Conveyance 38 is then pulled upwardly until the corresponding features 86 of retrievable dynamic seal 24 are moved into engagement with ram portions 82 and retrievable dynamic seal 24 is positioned at desired location 42, as illustrated in FIG. 5.

Figure 6:
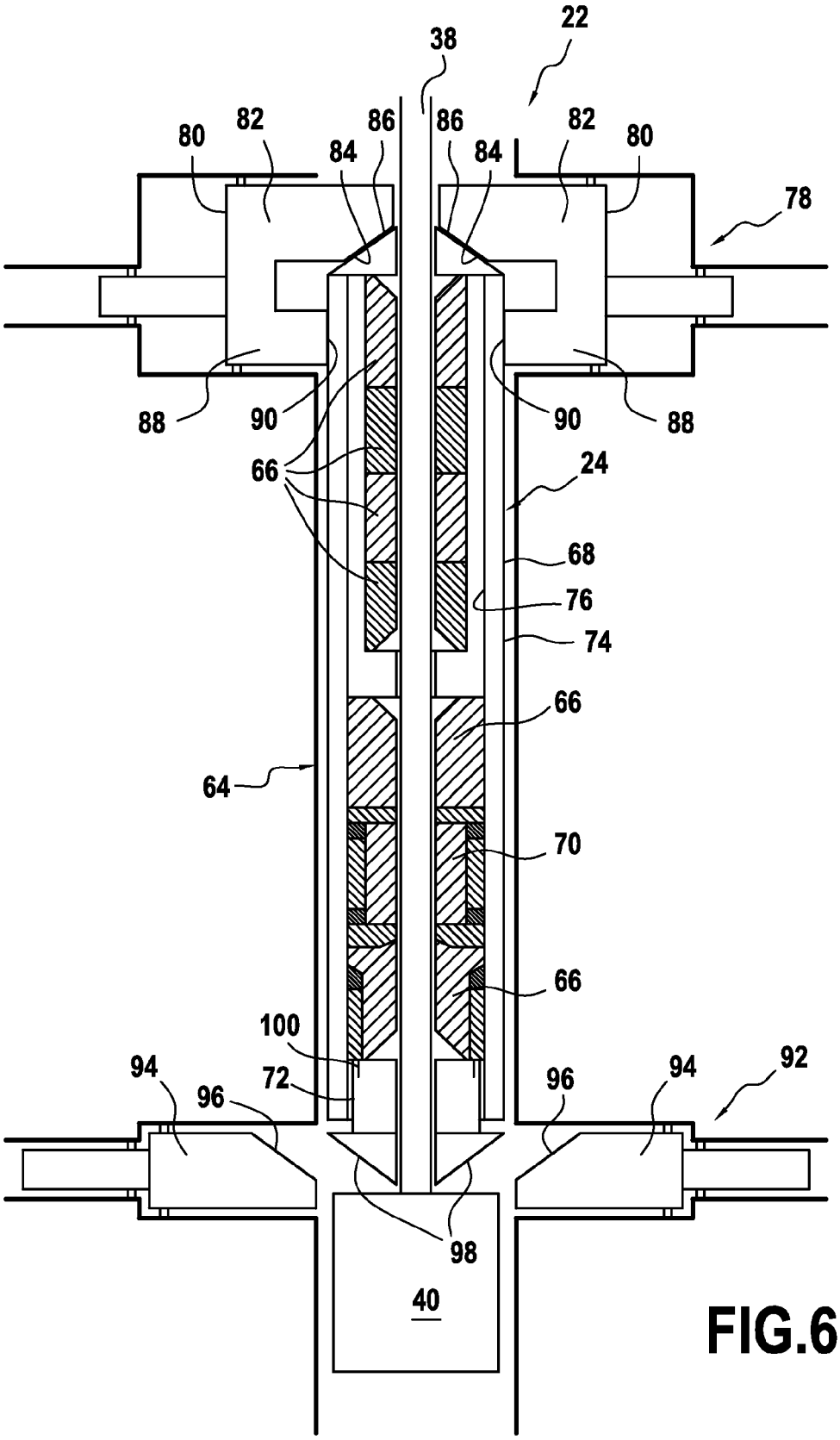
FIG. 6 is a schematic illustration of the retrievable dynamic seal positioned in a subsea installation during a subsequent stage of deployment, according to an embodiment of the present invention.

The rams 80 are then further moved radially inward to a closed position, as illustrated in FIG. 6. In the closed position, gripping surfaces 90 of gripping portions 88 are fully engaged with body 68 to lock retrievable seal device 24 in place and to form a seal against the outer surface 74 of body 68. Movement of the rams 80 to the closed position also can be used to release retrievable dynamic seal 24 from the conveyance 38 and/or tool string 40 to enable lowering of the tool string 40, as described in greater detail below.

Figure 7:
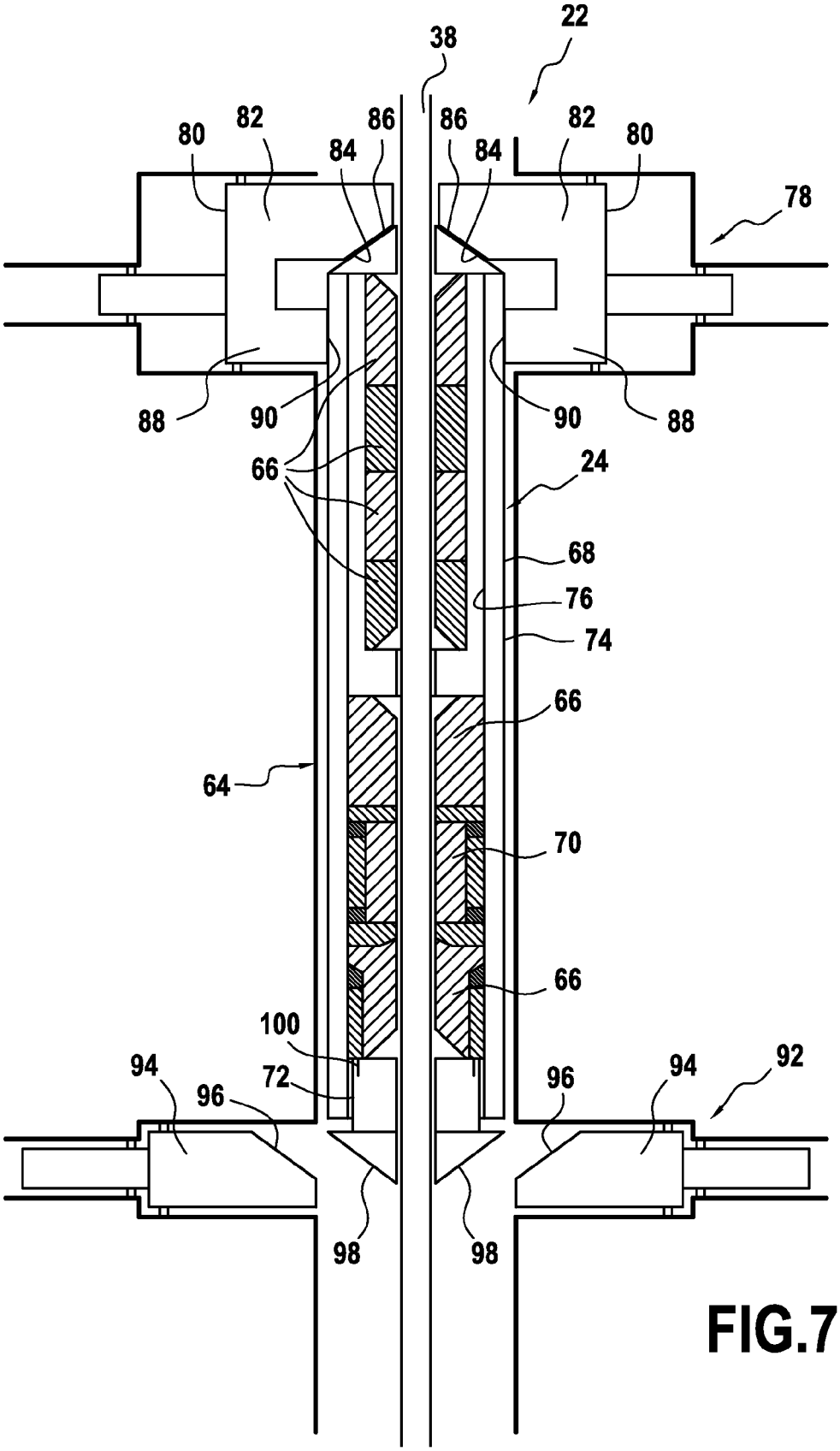
FIG. 7 is a schematic illustration of the retrievable dynamic seal positioned in a subsea installation during a subsequent stage of deployment, according to an embodiment of the present invention.
Figure 8:
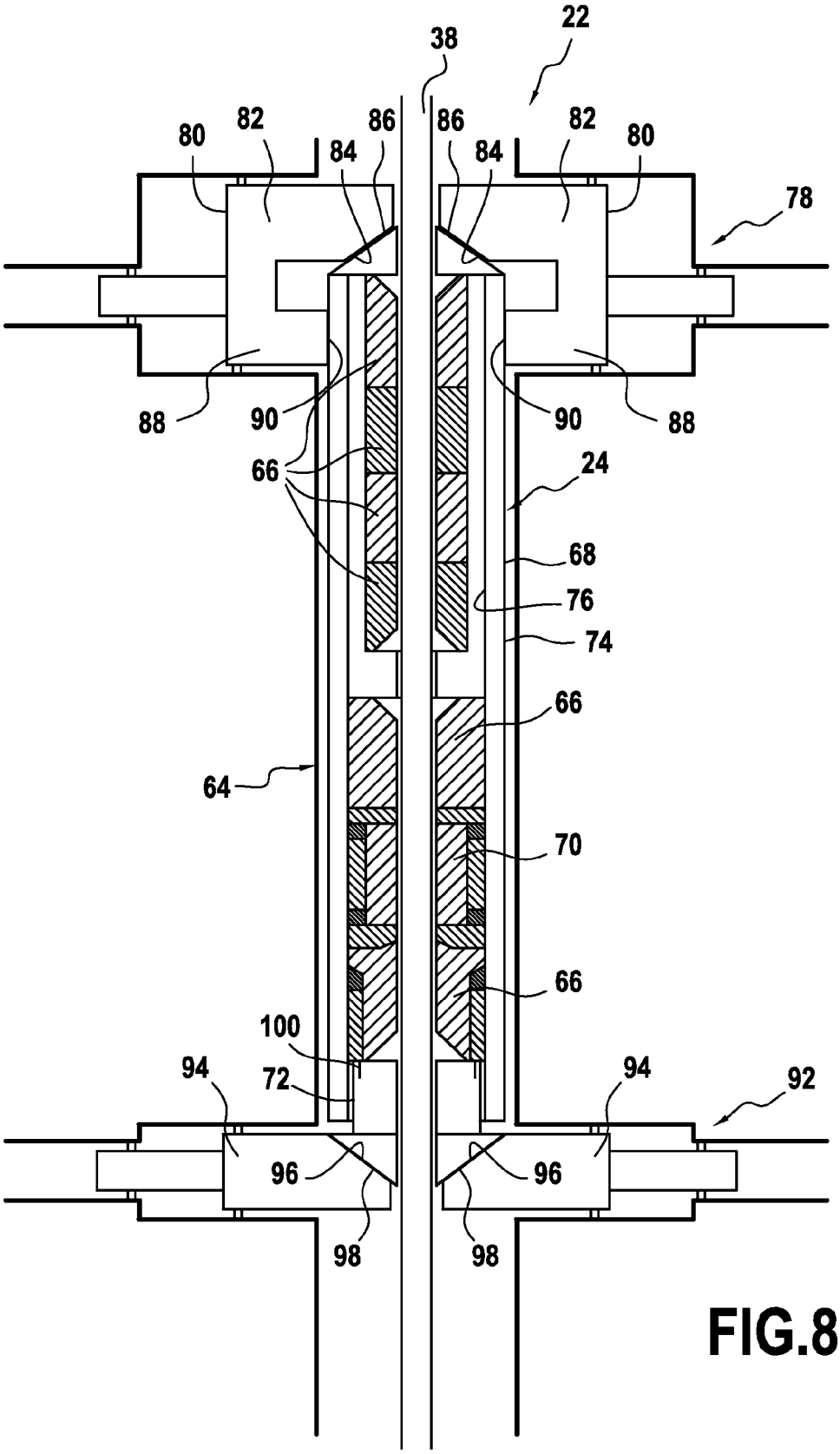
FIG. 8 is a schematic illustration of the retrievable dynamic seal positioned in a subsea installation during a subsequent stage of deployment, according to an embodiment of the present invention.

The tool string 40 can then be lowered a short distance, as illustrated in FIG. 7, to provide space for actuation of retrievable dynamic seal 24. In the embodiment illustrated, space is provided to enable radially inward movement of activating rams 94. However, this initial lowering of tool string 40 can be avoided if the retrievable seal device 24 is installed on conveyance 38 with sufficient spacing between the retrievable dynamic seal 24 and the tool string 40. Regardless, the activating rams 94 are moved radially inward against corresponding features 98 of activating cursor 72. Sufficient inward movement of activating rams 94 causes the linear, upward movement of activating cursor 72 which, in turn, compresses sealing element 70 until a sufficient seal is formed against conveyance 38, as illustrated in FIG. 8.

Once the sufficient seal is formed against conveyance 38, conveyance 38 can be moved through the retrievable dynamic seal 24 while maintaining a fluid/pressure barrier. This allows tool string 40 to be lowered or otherwise moved to perform a desired intervention operation. After the intervention operation has been performed, the tool string 40 is retrieved into subsea installation 26 which allows the well to be closed. Pressure in the subsea installation 26, e.g. in lubricator 50, is then bled off, and activating rams 94 are moved radially outward to deactivate sealing element 70 and retrievable dynamic seal 26. The upper rams 80 can then be opened so that conveyance 38, retrievable seal device 24, and tool string 40 can be recovered to the surface.

Figure 9:
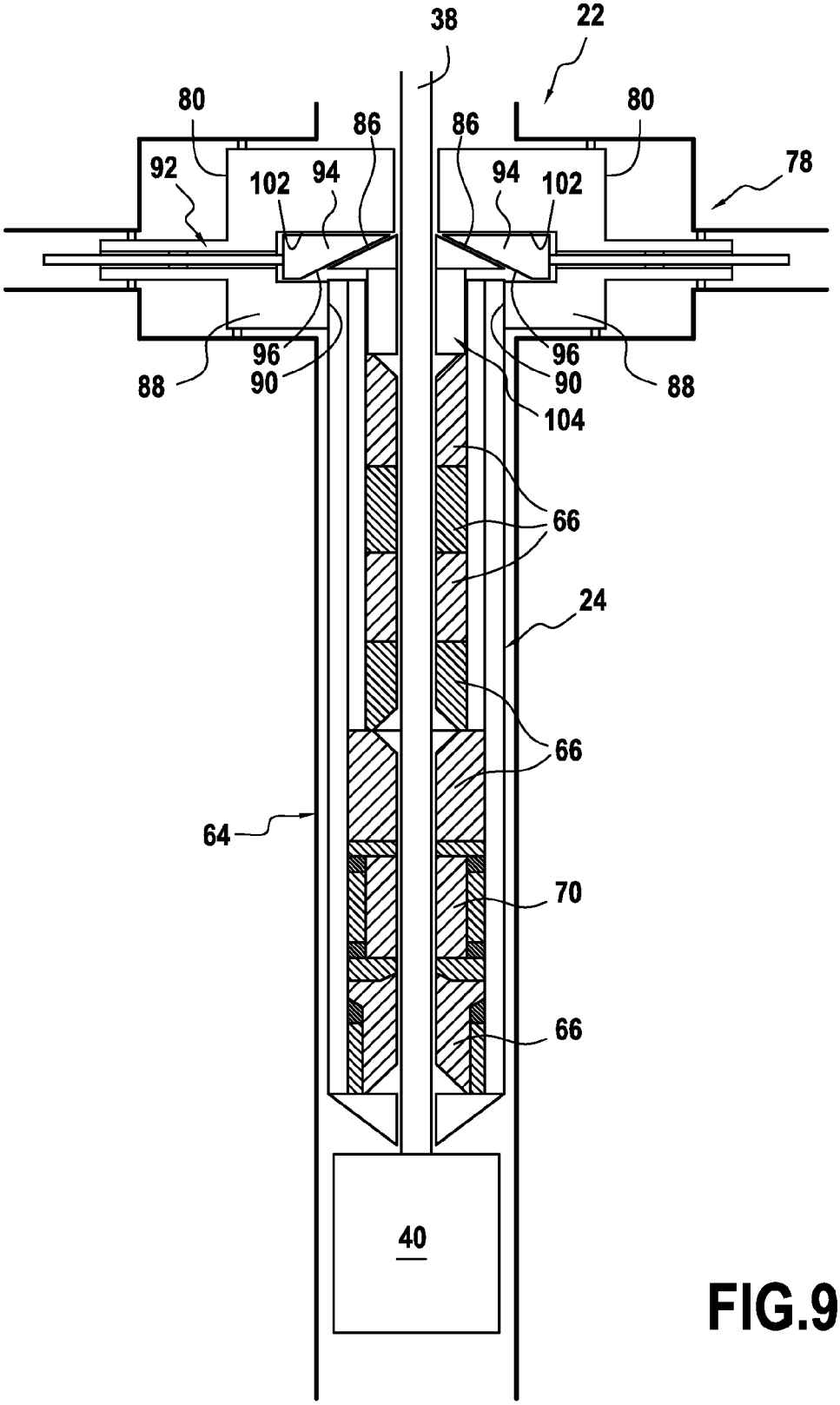
FIG. 9 is a schematic illustration of an alternative retrievable dynamic seal positioned in a subsea installation, according to an alternate embodiment of the present invention.

In FIG. 9, another embodiment of dynamic seal system 22 is illustrated. In this embodiment, activating rams 94 are deployed generally on the same end of retrievable dynamic seal 24 as rams 80. In the illustrated example, activating rams 94 are slidably positioned within corresponding recesses 102 formed in rams 80. In operation, rams 80 are moved to a partially closed position to locate the retrievable dynamic seal 24 at the desired location 42. The rams 80 are then transition to the fully closed position in which gripping portions 88 are forced against retrievable dynamic seal body 68 to secure the retrievable dynamic seal 24. The internal activating rams 94 can then be forced radially inward to act against corresponding features 86. Continued inward movement of activating rams 94 causes linear movement of an upper activating cursor 104. The linear movement of cursor 104 is transitioned through several bushings 66 to compress sealing element 70 until a suitable seal is formed against conveyance 38. The embodiment illustrated in FIG. 9 requires only one structure to contain both positioning mechanism 78 and activating rams 94 which can reduce the size and weight of the intervention equipment.

Figure 10:
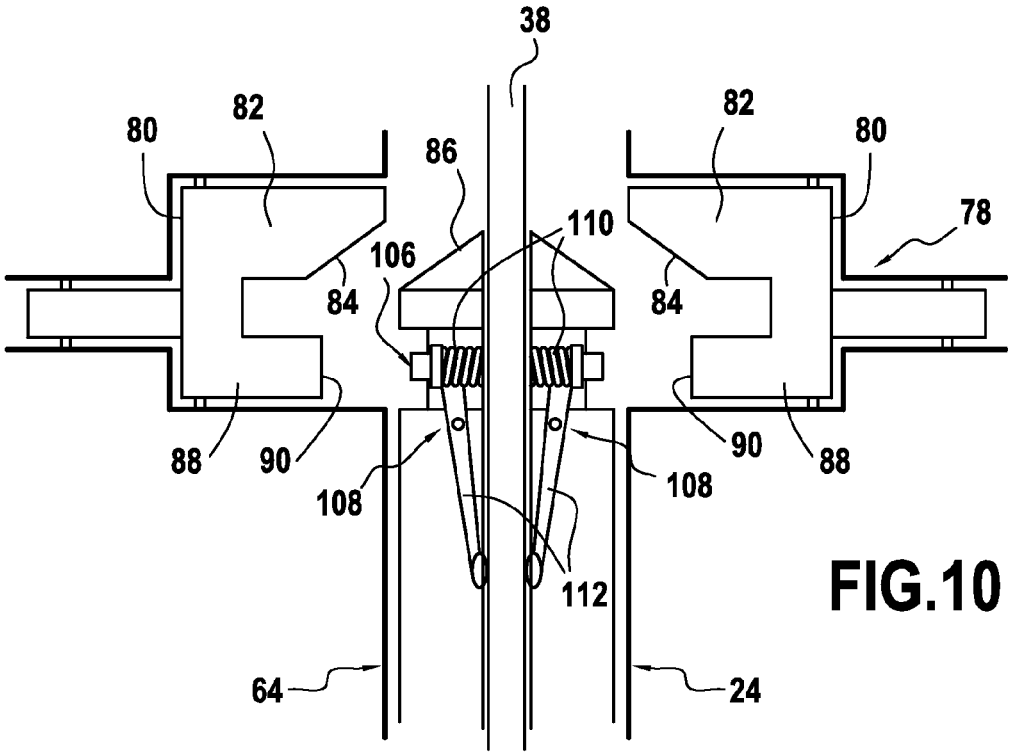
FIG. 10 is a schematic illustration of the retrievable dynamic seal positioned in a subsea installation and illustrating one embodiment of a device for temporarily locking the retrievable dynamic seal system to a conveyance, according to an embodiment of the present invention.
Figure 11:
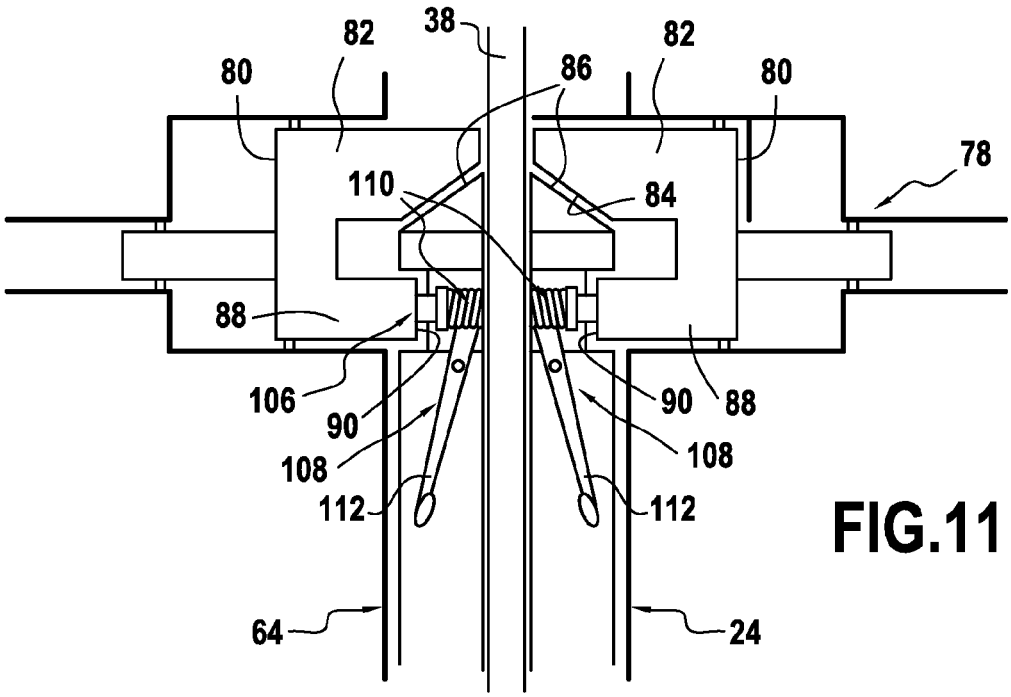
FIG. 11 is a schematic illustration similar to that of FIG. 10 but showing the device for temporarily locking in a released position, according to an embodiment of the present invention.

In some applications, retrievable dynamic seal 24 is temporally locked to conveyance 38 and/or tool string 40 during deployment and retrieval. A variety of locking systems can be used to temporarily lock retrievable dynamic seal 24, but one example of a locking system 106 is illustrated in FIGS. 10 and 11. In this example, locking system 106 comprises one or more spring-loaded members 108 each having a spring 110 positioned to bias an arm member 112 into gripping engagement with conveyance 38, as illustrated in FIG. 10. However, when rams 80 are moved to the closed position, the gripping portions 88 engage spring loaded members 108 and overcome the spring bias. Once the spring bias is overcome, the arm members 112 are released from conveyance 38, as illustrated in FIG. 11.

Figure 12:
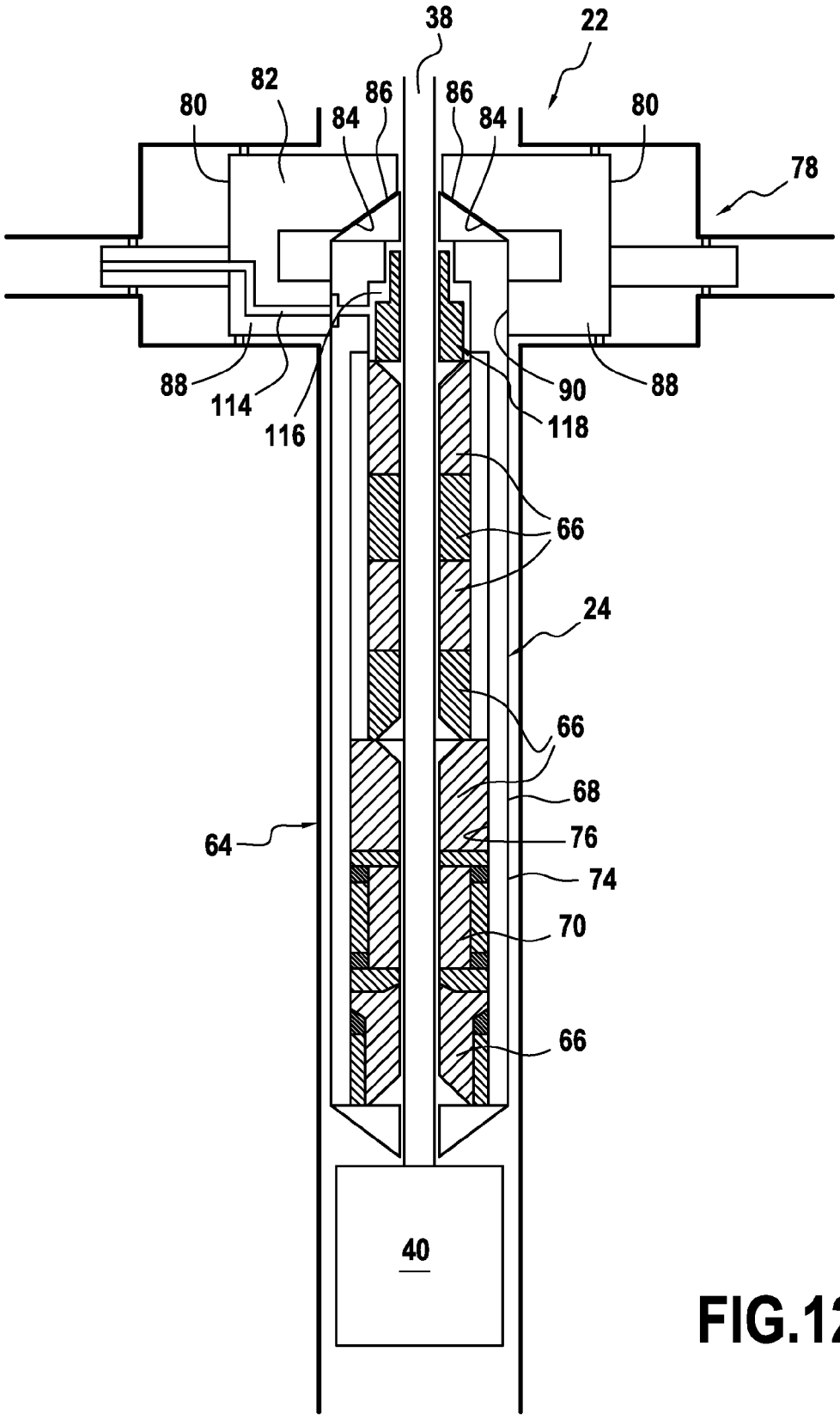
FIG. 12 is a schematic illustration of an alternative retrievable dynamic seal positioned in a subsea installation, according to an alternate embodiment of the present invention.

Another embodiment of dynamic seal system 22 is illustrated in FIG. 12. In this embodiment, only one set of rams is used. For example, the upper rams 80 can be used to position retrievable dynamic seal 24 at the desired location 42 within tubular 64. The rams 80 also can be moved to the fully closed position to grip retrievable seal device 24 while forming a pressure tight seal with retrievable dynamic seal body 68. In this embodiment, however, activation of sealing element 70 is not achieved through mechanical force applied to activating rams. Rather, a pressurized fluid is conveyed along a conduit 114 through one or both rams 80. The pressurized fluid is directed to a pressurized fluid cavity 116 formed and sealed within retrievable dynamic seal body 68. The pressurized fluid within cavity 116 is directed against an activating cursor 118 and forces the cursor 118 to move in a manner that activates sealing element 70. For example, cursor 118 can be moved linearly downward to transition several of the bushings 66 and to compress sealing element 70. By controlling the pressure of the fluid in pressure fluid cavity 116, the sealing force applied to the sealing element 70, and thus against conveyance 38, can be adjusted.

Dynamic seal system 22 can be integrated into a variety of intervention systems 20 for use in many types of environments. For example, dynamic seal system 22 can be used with intervention operations performed through open water or through a tubular, such as tubular 34. Additionally, dynamic seal system 22 can be positioned at a variety of desired locations 42 on, in or proximate subsea installation 26. Many types of components also can be incorporated into the dynamic seal system. For example, the positioning and actuation systems may comprise rams or other manipulation mechanisms. Additionally, individual sealing elements 70 or a plurality of sealing element 70 can be used in the retrievable dynamic seal 24. For example, two or more sealing elements 70 can be used in tandem. The sequence, number and position of the various bushings 66 and sealing elements 70 also can be changed. Furthermore, the number of rams or other manipulation devices can vary from one design to another. Similarly, the actuation of retrievable dynamic seal can be achieved by inducing the desired actuation forces hydraulically, mechanically, electrically, or through another suitable activation technique. The activation forces can be applied from a lower end of the retrievable dynamic seal or from an upper end of the retrievable dynamic seal depending on the arrangement of the positioning mechanisms, gripping mechanisms, and activation mechanisms.

Although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A method for use with a subsea installation, comprising:

mounting a retrievable dynamic seal on a conveyance above a tool string;

delivering the tool string and retrievable dynamic seal to a subsea installation;

using a portion of a ram with an oblique surface to position the retrievable dynamic seal in the subsea installation;

gripping the retrievable dynamic seal with the ram to lock the retrievable dynamic seal in place while creating a seal with a body of the dynamic seal; and activating the retrievable dynamic seal against the conveyance to maintain a seal with the conveyance as the tool string is moved, wherein activating includes compressing the seal element using a second ram.

2. The method as recited in claim 1, further comprising:

conducting an intervention operation in a subsea well with the tool string;

releasing the retrievable dynamic seal; and retrieving the retrievable dynamic seal to a surface location.

3. The method as recited in claim 1, wherein mounting comprises temporarily locking the retrievable dynamic seal to at least one of the conveyance and the tool string.

4. The method as recited in claim 1, wherein gripping comprises closing the ram onto a body of the retrievable dynamic seal.

5. The method as recited in claim 1, wherein activating comprises moving an activating cursor.

6. The method as recited in claim 5, wherein moving comprises moving the second ram against the activating cursor.

7. The method as recited in claim 5, wherein moving comprises moving the activating cursor with a pressurized fluid.

8. The method as recited in claim 1, wherein mounting comprises using a spring-loaded member to grip the conveyance.

9. A system, comprising:

a retrievable dynamic seal deployed on a conveyance, the retrievable dynamic seal having a seal element and an activating cursor to selectively cause the seal element to sealingly engage the conveyance;

a subsea installation having at least one ram located to position and temporarily secure the retrievable dynamic seal, wherein the at least one ram comprises a portion with an oblique surface to engage a corresponding oblique surface on the retrievable dynamic seal; and at least one activation ram located external to the retrievable dynamic seal configured to selectively move the activating cursor toward the seal element once the retrievable dynamic seal is temporarily secured in the subsea installation.

10. The system as recited in claim 9, further comprising a tool string coupled to the conveyance below the retrievable dynamic seal.

11. The system as recited in claim 9, wherein the retrievable dynamic seal comprises a body enclosing the seal element and a plurality of bushings.

12. The system as recited in claim 9, wherein the retrievable dynamic seal comprises a locking system that may be actuated to temporarily lock the retrievable dynamic seal to the conveyance.

13. The system as recited in claim 9, wherein the actuation system comprises an activating ram positioned to engage the activating cursor on a generally opposite end of the retrievable dynamic seal relative to the ram.

14. The system as recited in claim 9, wherein the actuation system comprises an activating ram positioned to engage the activating cursor on generally the same end of the retrievable dynamic seal relative to the ram.

15. The system as recited in claim 9, wherein the actuation system comprises a high pressure chamber to receive a high pressure fluid that acts against the cursor.

16. A method, comprising:

deploying a tool string and a retrievable dynamic seal on a conveyance to a subsea installation;

using at least a first portion of a first ram at the subsea installation to engage an upper end surface of the retrievable dynamic seal, wherein the first portion of the first ram and the upper end surface of the retrievable dynamic seal are corresponding oblique surfaces, and at least a second portion of the first ram to engage an outer side surface of the retrievable dynamic seal to secure the retrievable dynamic seal at a desired position in the subsea installation, wherein the second portion of the first ram and the outer side surface of the retrievable dynamic seal are corresponding oblique surfaces;

selectively actuating the retrievable dynamic seal with a second ram to linearly compress a seal element until the seal element is forced into sealing engagement with the conveyance.

17. The method as recited in claim 16, further comprising releasing the retrievable dynamic seal from the conveyance and moving the tool string into a well.

18. The method as recited in claim 17, further comprising employing the tool string to perform an intervention operation.

19. The method as recited in claim 18, further comprising releasing at least one of the rams and withdrawing the retrievable dynamic seal and the tool string to a surface location.

20. The method as recited in claim 16, wherein selectively actuating comprises moving the second ram against an activating cursor.

21. The method as recited in claim 20, wherein selectively actuating comprises moving the second ram along a recess in the ram used to secure the retrievable dynamic seal.

22. The method as recited in claim 16, wherein selectively actuating comprises moving the second ram with high pressure fluid delivered through a conduit.

23. The method as recited in claim 16, further comprising temporarily locking the retrievable dynamic seal to the conveyance with a spring biased locking mechanism.

24. A system, comprising:

a retrievable dynamic seal deployed on a conveyance, the retrievable dynamic seal comprising:

a seal element;

a housing; and an activating cursor to selecting cause the seal element to sealingly engage the conveyance;

at least one ram located to position and temporarily secure the retrievable dynamic seal; and at least one activating ram located external to the housing of the retrievable dynamic seal to selectively move the activating cursor toward the seal element once the retrievable dynamic seal is temporarily secured in a subsea installation.

25. The system of claim 24, wherein:

the at least one ram comprises a portion with an oblique surface to engage a corresponding oblique surface on the retrievable dynamic seal; and the at least one activating ram comprises a portion with an oblique surface to engage a corresponding oblique surface on the activating cursor.

* * * * *